United States Patent [19]

Beney et al.

[11] Patent Number: 4,473,325

[45] Date of Patent: Sep. 25, 1984

[54] BOLT HOLDER ON A DRILLING AND BOLTING TURRET

[75] Inventors: Gilbert Beney, Meyzieu; Michel Combet, Caluire, both of France

[73] Assignee: Eimco-Secoma Société Anonyme, Meyzieu, France

[21] Appl. No.: 492,077

[22] Filed: May 6, 1983

[30] Foreign Application Priority Data

May 6, 1982 [FR] France ..... 82 08202

[51] Int. Cl.[3] ..... E21D 11/00

[52] U.S. Cl. ..... 405/303; 173/22; 173/43; 405/259

[58] Field of Search ..... 405/259–261, 405/303; 173/22, 23, 38–42, 31, 35; 175/52, 315; 29/809, 811, 813

[56] References Cited

U.S. PATENT DOCUMENTS

| | | | |
|---|---|---|---|
| 3,218,893 | 11/1965 | Madison et al. | 173/22 X |
| 3,670,387 | 6/1972 | Nagao | 29/809 X |
| 3,913,754 | 10/1975 | Swartz et al. | 414/22 |
| 4,158,520 | 6/1979 | Prebensen | 405/260 |
| 4,226,559 | 10/1980 | Prebensen | 405/303 |
| 4,229,124 | 10/1980 | Frey et al. | 405/260 X |
| 4,398,850 | 8/1983 | Talvensaari | 405/261 |

FOREIGN PATENT DOCUMENTS

| | | | |
|---|---|---|---|
| 1359297 | 3/1964 | France | 405/259 |

*Primary Examiner*—Dennis L. Taylor

*Attorney, Agent, or Firm*—Karl F. Ross; Herbert Dubno

[57] ABSTRACT

A feed device on a drilling and bolting turret retains anchoring bolts, before they are driven into a bore in a subterranean structure. A centering member is supported by the front part of the turret and comprises a cylindrical housing into which a circular support plate of a bolt is introduced. The shank of the bolt is introduced laterally through an aperture in the centering member. A clamping jack of the rotary and linear type, actuates a push-rod which, when it is located opposite the centering member, makes it possible to push the plate of the bolt to the bottom of the housing and retain it there.

13 Claims, 5 Drawing Figures

10
20
9
1
19
5
17
2
31
30
32
29
46
21
49
33
34
28
6
27
11
47
26
25
42
39
40
12
41
43
44
36
38

BOLT HOLDER ON A DRILLING AND BOLTING TURRET

CROSS REFERENCE TO RELATED APPLICATIONS

This application is related to the commonly assigned copending applications:

Ser. No. 462,989 filed Feb. 1, 1983,

Ser. No. 463,004 filed Feb. 1, 1983.

Consideration may also be given to the following application:

Ser. No. 199,683 filed Oct. 22, 1980, now U.S. Pat. No. 4,395,163, and to the following U.S. patents which are in related fields:

U.S. Pat. Nos. 3,246,705, 4,105,081, 4,291,771, 4,300,642 and 4,326,449.

FIELD OF THE INVENTION

This invention relates to a device for receiving bolts and holding them in position as they are introduced for drilling and bolting turret and, more particularly to a bolt feeder therefor.

BACKGROUND OF THE INVENTION

In the formation of mine galleries and in the stabilization of subterranean structures generally, it is known to provide drilling and bolting means which have the capacity of drilling a bore, sometimes referred to as a borehole, in the rock structure to receive the bolt, and to insert the bolt with or without a material which suffices to permit anchoring of the bolt in place. The bolt may be provided with a screwthread or other helical rib formation, may be simply inserted axially or rotated and may be accompanied by a bag, pouch or other container of an epoxy resin, for example, which can be hardened in place.

Such drilling and bolting means can comprise a vehicle body which can move through the mine gallery on wheels or treads, an arm articulated on this body so as to be able to manoeuver the drilling and bolting head into practically any position opposite a wall or roof of the gallery, a drilling and bolting turret on this head which can alternately position a drill and a bolt-setting mechanism at the location at which the bolt is to be set and, of course, a mechanism for operating the arm from a remote location, a mechanism for rotating the rocket drill and guiding it to form the borehole, and a mechanism for setting the bolt in place.

It is also known with such means to provide a bolt magazine in which a plurality of bolts may be accummulated for individual feeding to the bolting turn, and a transfer device for shifting the bolts to the bolting head.

The turret can be of the type comprising a girder mounted to pivot about an axis at the end of a support arm and comprising means for guiding two carriages as they slide, in a direction parallel to the pivoting axis of the girder, one carriage for drilling a hole and the other for the introduction of a bolt into the hole drilled and for tightening it, as well as means for controlling the advance and return movements of the two carriages, other control means being provided for the pivoting of the girder in order to bring the second carriage in line with the axis of the hole drilled previously by the first carriage and also for the longitudinal movement of the girder arrangement parallel to its pivot axis.

A turret of this type, which is used in the field of mining, in particular for operations of supporting the roof and the faces of a mine-level or gallery, is already described for example by British Pat. No. 1 016 125. This turret is equipped for drilling a hole by means of the first carriage which drives a drilling bit and then in order to introduce an anchoring bolt into the hole and to tighten it by means of the second carriage constituting a screwing arrangement. Anchoring of the apparatus to the roof or face of the level is carried out along the pivot axis of the turret, in order that before its introduction operation, the axis of the bolt corresponds exactly to the axis of the hole drilled. A turret of this type is advantageously associated with a bolt magazine, in order to be able to drill a series of holes and introduce bolts into the latter progressively, virtually without manual intervention.

In present constructions of turrets of this type, if the bolt is taken from a magazine, it is received and in all cases held in position during introduction by two grippers or "small forks" whose supports are fixed to the turret.

These grippers must be retractable in order to allow the passage of the second carriage constituting the screen arrangement, which necessitates movable parts, pivot axis, return springs, stops, which complicate the construction.

OBJECTS OF THE INVENTION

It is the principal object of the present invention to provide an improved drilling and bolting apparatus whereby the disadvantages enumerated above and others which will be readily apparent to the ordinary skilled worker in the art can be obviated.

Another object of the invention is to provide an improved device for receiving bolts and holding them in position during the bolt-setting operation on a drilling and bolting turret which can form part of a drilling and bolting machine of an otherwise conventional design as described above.

Yet another object of this invention is to provide a drilling and bolting device which is less complicated than earlier constructions but which provides a more accurate and positive setting of the bolt.

Another object of the invention is to eliminate or at least mitigate the drawbacks described by receiving and holding the bolts in position, making it possible to eliminate grippers of the type hither to used, this device taking advantage of the plates generally supported by the anchoring bolts and originally intended to encourage the support of the bolt heads against the rock, in order to center and retain the bolts.

SUMMARY OF THE INVENTION

According to the invention there is provided a device to receive bolts and hold them in position as they are introduced, this device being mounted on a drilling and bolting turret comprising a girder mounted to pivot about an axis at the end of a support arm and comprising means for guiding first and second carriages as they slide in a direction parallel to said pivot axis of the girder.

The first carriage is used for drilling a hole and the second carriage is used for the introduction of a bolt into the drilled hole and tightening the bolt.

First control means is provided to control the advance and return movements of the two carriages, second control means being provided to control pivoting of the girder in order to bring the second carriage into line with the axis of the hole drilled previously by the first carriage and also for the longitudinal movement of the arrangement of the girder parallel to its pivot axis.

According to the invention, the device comprising a centering member supported by the turret in its front part and located in line with the axis of the second carriage, the centering member comprising an aperture for the axial passage of a screwing key of the second carriage. This aperture opens out laterally for the lateral introduction of a said bolt. A support plate of the bolt is retained against a part of the centering member directed towards the front of the turret.

In a preferred embodiment adapted in particular for handling bolts provided with a support plate of a circular shape, the centering member comprises a cylindrical housing whereof the base is directed towards the front of the turret, this housing opening out laterally like the aperture which extends it and having a diameter greater than the width of said aperture.

The device for receiving and holding bolts in position does not have complex moving parts, is extremely simple and of low bulk and is sufficient on its own at least in the case of vertical bolting, thus in the case of bolting of the "roof" with or without the use of a bolt magazine.

In both cases, the bolt is perfectly centered on the bolting axis, on one side by the screwing key provided on the second carriage of the turret and on the other side by its own support plate, introduced and centered in the cylindrical housing of the centering member.

The cylindrical housing may have a flared entrance, promoting the introduction of the bolt plate into this housing, in particular when using a bolt magazine. In fact, the transfer of the bolt from the magazine to the turret takes place by gravity, the bolt plate "dropping" into the housing, until it comes to rest on the bottom of this housing. Then, during screwing, the bolt slides freely in its plate which remains at the bottom of the housing, until the head of the bolt arrives in contact with the plate and entrains it therewith towards the "roof" of the level. At the end of screwing, the key of the second carriage passes through the aperture in the centering member, the width of this aperture being sufficient for the passage of the key, while remaining smaller than the diameter of the housing which corresponds substantially to that of the bolt support plate.

In the case of bolting in any non-vertical direction, the introduction and retention of the bolt on the centering member can clearly not be ensured solely by gravity.

The device for receiving and holding the bolt in position according to the invention is in this case provided with a clamping jack of the "rotary and linear" type, supported by the turret in its front part and moving a pushrod in a rotary and longitudinal manner, which is able to be located either opposite the centering member, or on the side of the centering member and is able to be brought closer to said member in order to clamp the support plate of a bolt between itself and this member. The linear movement of the clamping jack thus makes it possible to push the plate of the bolt into the corresponding housing in the centering member.

The rotary movement of this jack makes it possible to clear completely the passage of the plate and of the screwing key, for the purpose of introducing the bolt into the hole drilled. The push-rod moved by the clamping jack may be provided, at its free end, with a lug directed towards the rear, by means of which this push-rod presses on the bolt plate, thus taking up the depth of the cylindrical housing in the centering member.

In one variation, the cylindrical housing is dispensed with, the plate of the bolt simply being maintained by gripping between the front face of said member and the push-rod. This variation simplifies the machining of the centering member and also eliminates the lug of the push-rod and above all it has the advantage of being able to be used on bolts provided with support plates of any shape, for example with support plates of square shape, which is the most usual at present.

In the case of a turret supplied from a bolt magazine, the device for receiving bolts and holding them in position is advantageously provided with at least two jaws mounted to pivot on the same axis on the bolt magazine against the action of return springs and able to center the bolt perfectly along the axis of the second carriage constituting the screwing arrangement and to hold this bolt before and during its transfer from the magazine to the turret. These jaws arranged on the magazine replace by simpler means the grippers supported by the turret.

Whatever the orientation of the turret, they make it possible to hold the first bolt presented by the magazine in position along the axis of the carriage constituting the screwing arrangement, until the bolt is completely taken over by the action of the clamping jack clamping its plate and by the advance of the second carriage bringing the screwing key around the rear end of the bolt. The jaws must then allow the extraction of the bolt, held by its two ends on the turret, at the time of pivoting of the turret bringing the second carriage into line with the axis of the hole drilled previously by the first carriage.

BRIEF DESCRIPTION OF THE DRAWING

The invention will now be further described, by way of example, with reference to the accompanying drawing showing an embodiment of the device formed according to the invention to receive bolts and hold them in position during their introduction, on a drilling and bolting turret. In the drawing.

SPECIFIC DESCRIPTION

Figure 1:
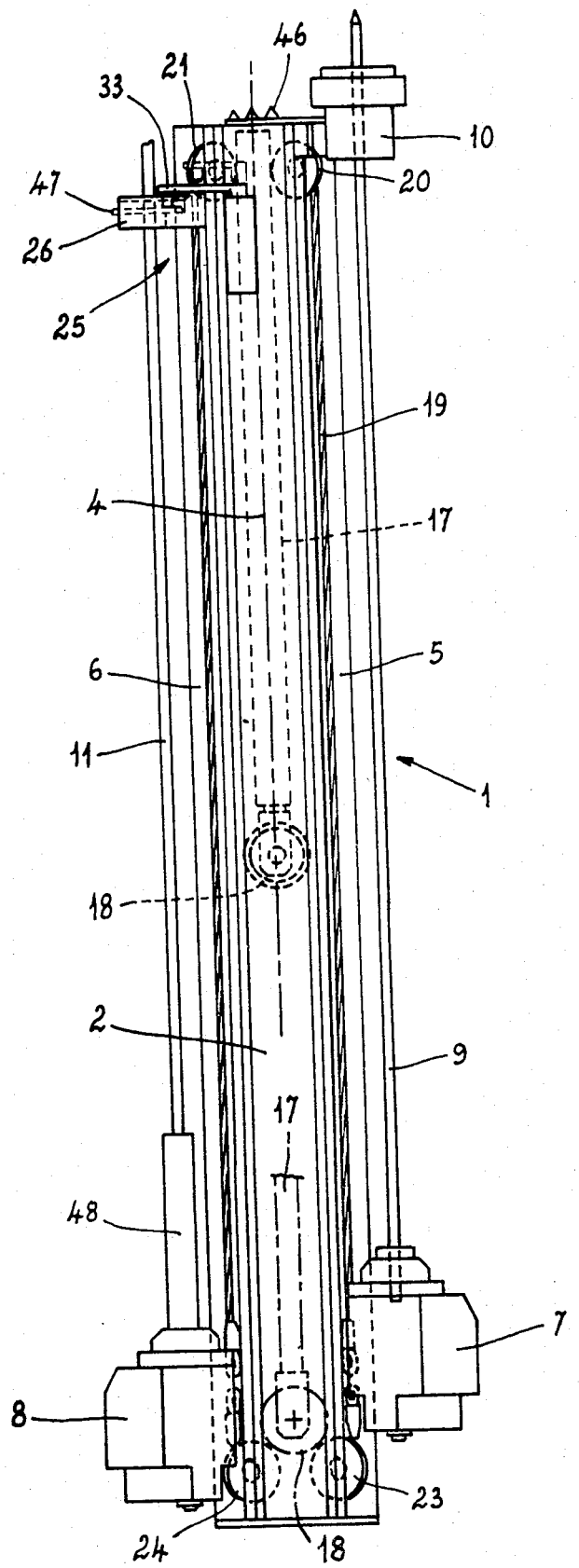
FIG. 1 is a front view of a drilling and bolting turret, equipped with a device formed according to the invention to receive bolts and hold them in position during their introduction.
Figures 3, 5:
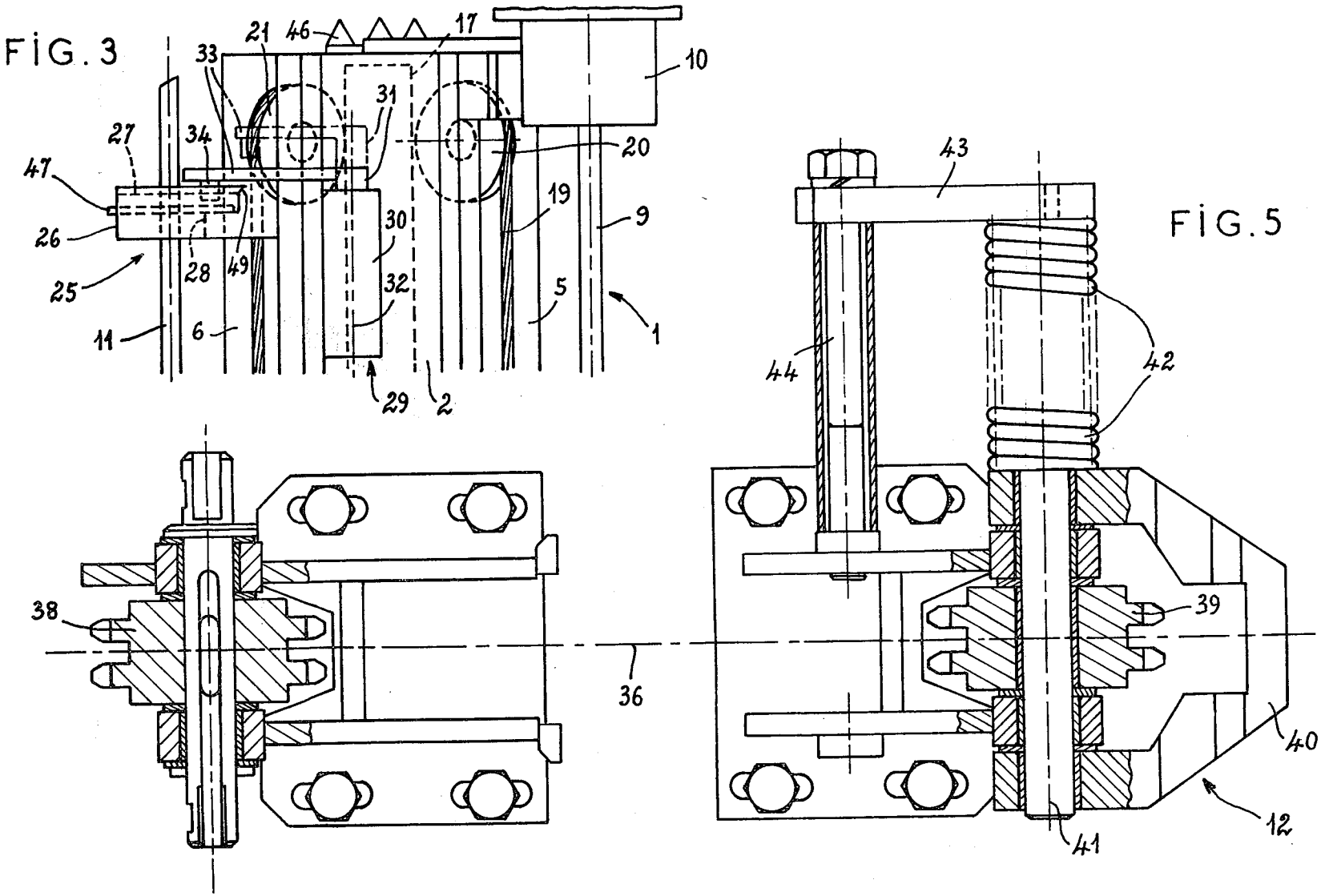
FIG. 3 is a detail view, on an enlarged scale, of the end of the turret of FIGS. 1 and 2 provided with said device for receiving bolts and holding them in position.
FIG. 5 is a side view, partly in section, showing the upper part of the bolt magazine of FIG. 4.

FIGS. 1 and 3 show a drilling and bolting turret 1 oriented vertically. The turret 1 comprises a girder 2, mounted to pivot and slide on a support box 3 along an axis 4. The support box 3, of a swan-neck shape, is in turn mounted to pivot at the end of a support arm which is not shown, supported by a mining appliance.

The girder 2 supports two rails 5 and 6, parallel to its pivoting and sliding axis 4, for guiding two carriages 7 and 8 longitudinally. The first carriage 7 constitutes a drilling machine equipped with a drilling bit 9, able to pass through a dust-collecting vessel 10 supported by one end of the girder 2. The second carriage 8 constitutes a screwing arrangement for tightening a bolt 11, taken from a bolt magazine 12 supported by the support box 3.

The pivoting movement of the turret 1 about the axis 4 is controlled by a first jack 13, pivoted between a "fixed" point 14 of the support box 3 and a connection 15 connected to rotate, through the intermediary of a tube 16, with the girder 2. The advance and withdrawal of the two carriages 7 and 8 are in this case obtained by a single common jack 17.

The body of the latter is connected to the girder 2 and the rod of the jack moves a double pulley 18, travelling in a groove of which is a tackle cable 19, which also travels over two return pulleys 20 and 21 and the ends of which are respectively attached to the two carriages 7 and 8.

When one of the carriages is immobilized and the jack 17 extends, the other carriage is moved forward. The withdrawal of one or other of the carriages 7 and 8, controlled by the retraction of the jack 17, is ensured through the intermediary of a reciprocal device, constituted by another tackle cable 22 travelling in a second groove of the pulley 18 as well as over return pulleys 23 and 24, it ends also being attached to the carriages 7 and 8.

Figure 2:
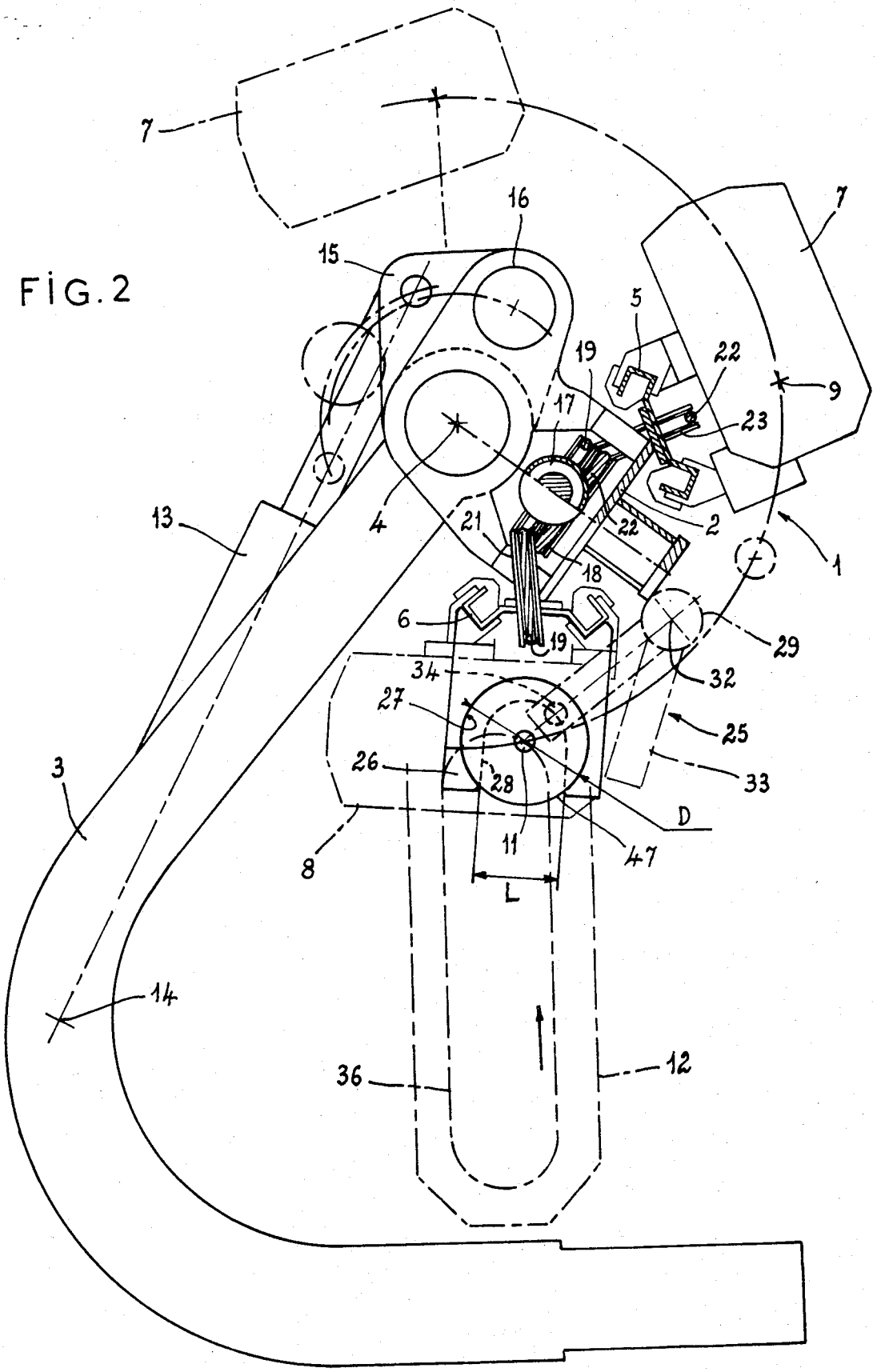
FIG. 2 is an end view partly in section of the turret in FIG. 1 associated with a bolt magazine.

In the turret 1, whose known features have been recalled, the invention relates more particularly to a device designated generally by the reference numeral 25 and serving to receive bolts 11 and hold the bolts in position during their introduction, the structure of this device being clearly visible in FIGS. 2 and 3.

The device 25 mainly comprises a centering member 26, supported by the front end of the rail 6 along which the second carriage 8 moves, this carriage constituting the screwing arrangement. The centering member 26, which extends perpendicular to the longitudinal direction of rail 6, comprises a cylindrical housing 27.

The bottom of the housing is directed towards the front of the girder 2 and an aperture 28 of U-shaped profile, having a width L less than the diameter D of the housing 27, the aperture 28 passing through the entire thickness of the member 26 between the bottom of the housing 27 and the rear face of this member. The housing 27 and aperture 28 open out on the side of the member 26 which is opposite the rail 6.

In the embodiment illustrated in the drawing, the device 25 intended for holding the bolts in position also comprises a clamping jack 29, the body 30 of which is supported by the girder 2 and located at the level of the centering member 26. This is a jack of the rotary-and-linear type, the rod 31 of which is both able to slide and pivot along the axis 32 of the body 30. The outer end of the rod 31 supports a push-rod in the form of a radial arm 33, in turn provided at its free end with a lug 34 directed towards the rear.

Figure 4:
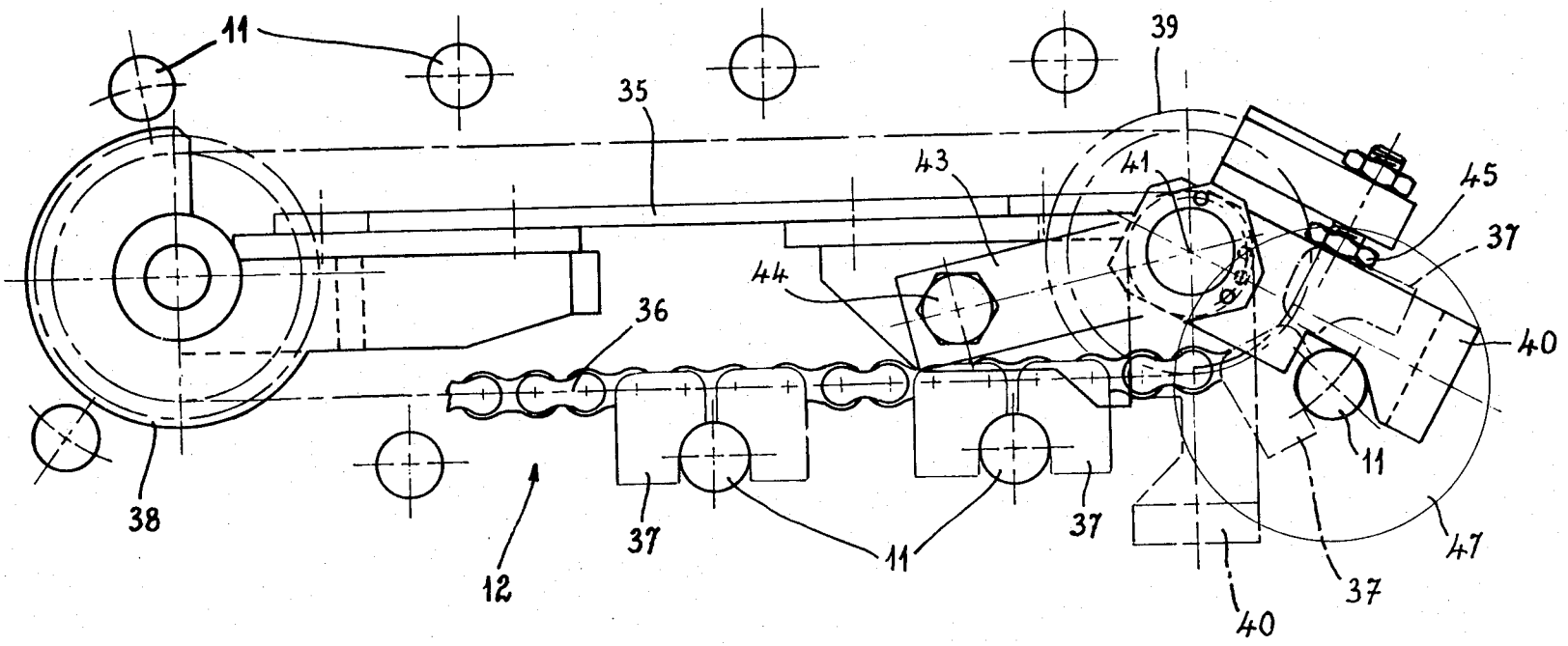
FIG. 4 is a more detailed plan view of the bolt magazine of FIG. 2, showing jaws for retaining bolts during their transfer between the magazine and the turret.

The device for receiving and holding bolts in position also comprises members supported by the bolt magazine 12, which in the embodiment illustrated comprises a frame 35 fixed to the support box 3 of the turret 1 and supporting at least two endless chains 36 located in parallel planes, each chain 36 being provided with pairs of claws 37 for retaining bolts 11 and passing over two pinions 38 and 39, one being a drive pinion and the other a return pinion (see FIGS. 4 and 5). The complementary members supported by the magazine 12 are constituted by at least two jaws 40, mounted to pivot about an axis 41 which coincides with the axis of rotation of the return pinions 39 of the endless chains 36.

More particularly, as shown in FIG. 5, each jaw 40 has a stirrup shape articulated on the axis 41 on either side of the adjacent pinion 39.

A helical return spring 42 connects each pivoting jaw 40 to a finger member 43 supported by a rod 44 integral with the frame 35 of the bolt magazine 12. Pivoting of the jaw 40, against the force of the return spring 42, is limited by a stop screw 45, the "inoperative" position of the jaw 40 being that shown in dot dash lines in FIG. 4.

The operation of the drilling and bolting turret 1, equipped with the device according to the invention for receiving bolts 11 and holding them in position during their introduction, is as follows: The turret 1 is initially anchored to the rock by its point 46 located at the front end of the pivot axis 4 of the girder 2 and it is first of all brought by means of the jack 13 into its drilling position shown in full line in FIG. 2, a position in which the axis of the bit 9 coincides with the axis of the hole to be drilled. By sliding along the axis 4, the girder 2 is also advanced until the dust-collecting vessel 10 comes into contact with the rock. The first carriage 7 is actuated in order to drill the hole by the bit 9.

Then the first bolt presented by the magazine 12 is taken up by the turret 1, the axis of the second carriage 8, constituting the screwing arrangement being located in the vicinity of the front end of the magazine 12.

The first bolt 11 is brought into line with the axis of the second carriage 8 by the mechanism for driving the chains 36 of the magazine 12. On approaching this axis, the first bolt 11 describes a trajectory in the form of an arc of a circle, thus entraining therewith the jaws 40, which pivot about the axis 41 by compressing the return springs 42, as far as the stationary position imposed by the stop screws 45 (of FIGS. 2 and 4).

At the same time, the shank of the bolt 11 is introduced laterally into the aperture 28 in the centering member 26. The bolt 11 in question, thus brought exactly into line with the axis of the second carriage 8, is initially held there by gripping between the jaws 40 and the claws 37 located in facing relationship.

The clamping jack 29 then moves the push-rod 33, initially retracted to the side of the centering member 26, by causing it to pivot towards a useful position in which this push-rod 33 is located opposite the centering member 26, its lug facing the circular support plate 47 of the bolt 11.

Then the jack 29 is actuated in order to move the push-rod 33 towards the centering member 26. The lug 34 presses on the plate 47 of the bolt 11 in order to push it as far as the bottom of the cylindrical housing 27 in the member 26. The control of the clamping jack 29 occurring at this instant is ensured either manually by the operator, by any conventional control member (either hydraulic or electro-hydraulic) or automatically by any system comprising a detector (operating by pressure, by mechanical contact, or in the manner of a proximity detector, etc . . . ) combined with the bolt magazine 12.

Finally, the second carriage 8 is moved forward so that its screwing key 48 (FIG. 1) surrounds the rear end of the bolt 11. This bolt 11 is thus finally held in position and centered, at the front, by its support plate 47 supported at the bottom of the cylindrical housing 27 of the member 26 and, at the rear, by the screwing key 48.

The girder 2 of the turret 1 may thus pivot about the axis 4, under the control of the jack 13, until the bolt 11, taken over as described above, is brought into line with the axis of the hole drilled previously. During this movement, the force of the jack 13 extracts the bolt 11 from the jaws 40, which are thus themselves released and returned to their inoperative position, under the action of return springs 42, in order to be ready to receive a new bolt to be introduced.

During the advance of the carriage 8 allowing the introduction and tightening of the bolt 11 in the hole drilled previously, the clamping jack 39 is actuated in order to return the push-rod 33 to the retracted position. At the end of screwing, the key 48 may thus pass through the aperture 28 in the centering member 26, the head of the bolt 11 entraining with it the plate 47 which is extracted from the cylindrical housing 27 and brought into contact with the rock. The retraction of the push-rod 33 may be controlled automatically, like the preceding actuation.

The description of the operation given above, which is valid if the turret 1 is associated with a bolt magazine and for any orientation of the turret 1, shows the function of all the members of the device which are involved in this case in a combined manner, namely the centering plate 26, clamping jack 29 and jaws 40.

In the case of bolting effected vertically with or without a bolt magazine 12, the clamping jack 29 may not be actuated, the support plate 47 of the bolt being introduced into the cylindrical housing 27 of the centering member 26 and being retained therein under the effect of gravity. In this case in particular, the housing 27 may have a flared entrance 49 (FIG. 3), facilitating the introduction and centering of the plate 47 into said housing.

In the absence of the bolt magazine and in the case of bolting in any direction in space, the jaws 40 clearly disappear, but the clamping jack 29 operates virtually in the same manner as described previously, the only difference being that the bolt 11 and its plate 47 are introduced manually into their respective housings in the key 48 and the member 26, instead of being presented along the axis of the second carriage 8 by the bolt magazine 12.

We claim:

1. In a drilling and bolting machine for drilling a borehole in a rock structure and setting a bolt therein, said machine comprising a drilling and bolting turret having a girder mounted to pivot about an axis, a support arm carrying said turret and defining said axis, first and second carriages guided on said turret and slidable parallel to said axis, said first carriage being provided with means for drilling said borehole, said second carriage being adapted to introduce a bolt into said hole and for tightening said bolt therein, first control means for controlling advance and return movements of said carriages, and second control means for pivoting said turret about said axis to bring said second carriage into line with the axis of said hole after is drilled by said first carriage, and for longitudinally displacing said girder parallel to said axis, the improvement which comprises a device for receiving such bolts and holding them in position while they are introduced into a hole by said second carriage, said device comprising a centering member supported by said turret at a front part thereof and located in line with an axis of said second carriage, said centering member comprising an aperture, a screwing key and said second carriage axially displaceable through said aperture, said aperture opening outwardly laterally from the lateral introduction of said bolt thereof, said bolt being formed at a rear end thereof with a support plate, said device including means for retaining said support plate against a part of said centering directly toward the front of said turret.

2. The improvement defined in claim 1 for use with bolts having support plates of circular shape, said part of said centering member being formed as a cylindrical housing having a base directed toward the front of the turret, said housing opening laterally corresponding to the lateral opening of said aperture, said aperture extending said housing with said housing having a diameter greater than the width of said aperture.

3. The improvement defined in claim 2 wherein said cylindrical housing has a flared mouth.

4. The improvement defined in claim 2 wherein said aperture has a U-shaped profile.

5. The improvement defined in claim 3 wherein said aperture has a U-shaped profile.

6. The improvement defined in claim 1 wherein said centering member is supported by the front end of rail along which said second carriage moves and said centering member extends perpendicularly to the longitudinal direction of said rail.

7. The improvement defined in claim 1, further comprising a clamping jack of the rotary-and-linear type supported by said turret at a front part thereof and moving a pushrod longitudinally and rotatably, said pushrod being disposed proximal to said centering member and movable toward said centering member to clamp a support plate of the bolt received in said aperture between said pushrod and said centering member.

8. The improvement defined in claim 5, further comprising a clamping jack of the rotary-and-linear type supported by said turret at a front part thereof and moving a pushrod longitudinally and rotatably, said pushrod being disposed proximal to said centering member and movable toward said centering member to clamp a support plate of the bolt received in said aperture between said pushrod and said centering member.

9. The improvement defined in claim 7 wherein said push-rod is in the form of a radial arm and is provided at a free end with a rearwardly directed lug adapted to bear upon a support plate of a respective bolt received in said aperture.

10. The improvement defined in claim 7 wherein said machine further comprises a bolt magazine having at least two jaws pivotable about the same axis against the action of return springs for centering a bolt along the axis of the second carriage.

11. The improvement defined in claim 9 wherein said machine further comprises a bolt magazine having at least two jaws pivotable about the same axis against the action of return springs for centering a bolt along the axis of the second carriage.

12. The improvement defined in claim 10 wherein said bolt magazine comprises at least two endless chains provided with claws for retaining said bolts, a pair of pinions over which each of said chains passes and means for supporting the pivot axis of said jaws along the axis of rotation of one of said pinions.

13. The improvement defined in claim 11 wherein said bolt magazine comprises at least two endless chains provided with claws for retaining said bolts, a pair of pinions over which each of said chains passes and means for supporting the pivot axis of said jaws along the axis of rotation of one of said pinions.

* * * * *